US006839537B2

(12) United States Patent
Mouri et al.

(10) Patent No.: US 6,839,537 B2
(45) Date of Patent: Jan. 4, 2005

(54) FIXING DEVICE

(75) Inventors: Syuhei Mouri, Nagano-Ken (JP); Kazutoshi Fujisawa, Nagano-Ken (JP); Takeshi Tajjima, Nagano-Ken (JP); Hiroshi Takehana, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/384,061

(22) Filed: Mar. 10, 2003

(65) Prior Publication Data

US 2003/0210933 A1 Nov. 13, 2003

(30) Foreign Application Priority Data

| | | |
|---|---|---|
| Mar. 11, 2002 | (JP) | 2002-065099 |
| Mar. 11, 2002 | (JP) | 2002-065100 |
| Mar. 11, 2002 | (JP) | 2002-065101 |
| Mar. 15, 2002 | (JP) | 2002-071722 |
| Mar. 15, 2002 | (JP) | 2002-071723 |

(51) Int. Cl.[7] ..... G03G 15/20
(52) U.S. Cl. ..... 399/323
(58) Field of Search ..... 399/323, 328, 399/335, 406, 331, 330; 219/216, 469, 470, 471

(56) References Cited

U.S. PATENT DOCUMENTS

| | | | | |
|---|---|---|---|---|
| 4,156,524 A | * | 5/1979 | Bar-on et al. | 399/323 |
| 2002/0164172 A1 | * | 11/2002 | Tsubaki et al. | 399/323 |
| 2003/0007817 A1 | * | 1/2003 | Saitoh | 399/406 |

FOREIGN PATENT DOCUMENTS

| | | |
|---|---|---|
| JP | 11-184300 | 7/1999 |

* cited by examiner

*Primary Examiner*—Susan Lee
(74) *Attorney, Agent, or Firm*—Sughrue Mion, PLLC

(57) ABSTRACT

In order to improve the peeling performance for peeling off a recording medium from a fuser roller and a pressure roller, peeling members 31, 32 are provided which are arranged on the downstream side in the recording medium feeding direction relative to a fixing nip portion to extend in the axial direction of the fuser roller 21 and the pressure roller 22 and are disposed in proximity to the fuser roller and the pressure roller, respectively. The positioning of the peeling member 31 for the fuser roller is conducted on the surface of the fuser roller, and the positioning of the peeling member 32 for the pressure roller is conducted on surfaces of bearings 25 for the pressure roller.

8 Claims, 10 Drawing Sheets

FIG. 8

| | Evaluation Items | Peeling Member : Alignment Angle | | | | |
|---|---|---|---|---|---|---|
| | | 30° | 25° | 10° | −5° | −10° |
| Example 1 | Linear Defect on image | ○ | ○ | ○ | △ | × |
| | Peeling Performance | × | △ | ○ | ◎ | ◎ |
| Example 2 | Linear Defect on image | ○ | ○ | ○ | △ | × |
| | Peeling Performance | × | △ | ○ | ◎ | ◎ |
| Example 3 | Linear Defect on image | ○ | ○ | ○ | △ | × |
| | Peeling Performance | × | △ | ○ | ◎ | ◎ |

FIXING DEVICE

BACKGROUND OF THE INVENTION

The present invention relates to an image forming apparatus utilizing electrophotographic technology such as a copying machine, a printer, and a facsimile machine and, more particularly, to a fixing device provided with a peeling member for peeling a recording medium fed out of a fixing nip portion.

Widely used as a fixing device for fixing a toner image transferred onto a recording medium such as a paper sheet in an image forming apparatus utilizing electrophotographic technology is a fixing device in which a sheet with a toner image transferred thereto is passed through a nip portion between a pair of rollers consisting of a fuser roller and a pressure roller to thereby fuse the toner image to the sheet by means of heating by the fuser roller and compression by the two rollers.

Generally, in the fixing device of this type, since the toner image fused to the sheet comes into contact with the fuser roller, a roller having a surface coated with a fluoro resin having high release property is used. However, even if such a fuser roller is used, the fused toner easily adheres to the surface of the fuser roller because it is soft and highly viscous, and the sheet may wind around the fuser roller.

Conventionally, in Japanese Patent Unexamined Publication H11-184300, a fixing device has been proposed which is provided with a sheet-like peeling member to be contact with a fuser roller on the downstream side. The peeling member comprises a resin sheet or a metal sheet as a substrate and a fluoro resin layer which is formed, by coating or applying, on the surface of the substrate and around an end of the substrate to be contact with the fuser roller.

In the aforementioned conventional fixing device, however, since the peeling member is in contact with the fuser roller, there is a problem that the fuser roller may be scratched. Then, a method is conceived that the peeling member is arranged not to be in contact with the fuser roller. However, this method has a problem that a gap between the end of the peeling member and the fuser roller must be held always constant over the entire length in the axial direction of the fuser roller in order to peel off a recording medium from the fuser roller with constant force over the entire width of the recording medium.

Moreover, in the conventional fixing device, it is common that the fuser roller and the pressure roller are arranged one above the other to be aligned in the vertical direction, and the feeding direction of the recording medium is substantially the horizontal direction. Therefore, a force acts on the recording medium, going out of the nip portion, in a direction moving apart from the fuser roller because of gravitation so that the prospect of peeling the recording medium by the peeling member is low.

However, when the fuser roller and the pressure roller are aligned in substantially the horizontal direction and the feeding direction of the recording medium is substantially the vertical direction, the recording medium easily winds around the fuser roller. In case of dual-side printing, there is also a problem that toner on the pressure roller side corresponding to locations where no toner is transferred on the fuser roller is fused so that the recording medium easily winds around the pressure roller. It may be conceived that another peeling member is provided on the pressure roller side. However, similarly to the peeling member on the fuser roller side, there is a problem that a gap between the end of the peeling member and the pressure roller must be held always constant.

In case that the fuser roller and the pressure roller are aligned in substantially the horizontal direction and a method of feeding a recording medium out of the fixing nip upwardly is employed, the recording medium easily winds around the fuser roller so that the recording medium always comes in contact with the peeling member, that is, the frequency in use of the peeling member is high. In this case, the setting of the contact angle of the peeling member relative to the recording medium is important. If the contact angle of the peeling member relative to the recording medium is not good, the peeling performance of recording media should be poor and linear defects may be created on image.

In the conventional fixing device, the peeling member is in contact with the fuser roller, so there is a problem that the fuser roller may be scratched. Since the conventional peeling member 51 has a fluoro resin layer 51*f* formed on the surface of a substrate 51*a* which has a round portion R on its end as shown in FIG. 10(A), an end portion of the resin layer 51*f* coming in contact with the recording medium is removed due to repeated use over the years as shown in FIG. 10(B). In this state, the recording medium is scratched by the round portion R having a larger contact area so that toner may adhere to the round portion and linear defects may be created on image.

Moreover, since the fuser roller and the pressure roller are normally biased against each other by springs at the both ends of the rollers, the middle portion of the pressure roller bulges because the elastic layer of the pressure roller is thick. As a result of this, the fuser roller is deflected into an arc shape in the axial direction. Therefore, it is very difficult to control the gap between the peeling member and the surface of the fuser roller. In case that the fuser roller and the pressure roller are aligned in substantially the horizontal direction, the recording medium easily winds around the fuser roller so that the recording medium always comes in contact with the peeling member, that is, the frequency in use of the peeling member is high, thus further increasing the importance of the control of the gap.

SUMMERY OF THE INVENTION

The present invention has been made in order to solve the aforementioned conventional problems. The first object of the present invention is to provide a fixing device which can achieve improved peeling performance of peeling off a recording medium from a fuser roller and a pressure roller.

For achieving the aforementioned object, a fixing device of the present invention comprises: a fuser roller having a heat source, a pressure roller to be pressed against the fuser roller, and peeling members which are arranged on the downstream side in the recording medium feeding direction relative to a fixing nip portion to extend in the axial direction of the fuser roller and the pressure roller and are disposed in proximity to the fuser roller and the pressure roller, respectively, and is characterized in that the positioning of the peeling member for the fuser roller is conducted on the surface of the fuser roller, and the positioning of the peeling member for the pressure roller is conducted on surfaces of bearings for the pressure roller.

The fixing device is further characterized in that the length in the axial direction of the pressure roller is shorter than that of the fuser roller and the bearings are arranged in spaces formed because of the difference in length, and that the fuser roller and the pressure roller are aligned in substantially the horizontal direction so that the recording medium feeding direction is the vertical direction.

The second object of the present invention is to provide a fixing device which can achieve improved peeling performance of peeling of f a recording medium from a fuser roller and a pressure roller and can prevent the occurrence of linear defects on image.

For achieving the aforementioned object, the fixing device of the present invention is characterized in that the alignment angle θ of the peeling member for the fuser roller is set in a range $-5° \leqq \theta \leqq 25°$ relative to the tangent line of the outlet of the fixing nip portion.

The third object of the present invention is to provide a fixing device which can achieve increased durability of a peeling member and can improve the quality of fixed image. For achieving the aforementioned object, the fixing device of the present invention is characterized in that the peeling member comprises a substrate having an edge at the end thereof and a fluoro resin layer formed on the surface of the substrate.

The fourth object of the present invention is to provide a fixing device in which the gap between the end of the peeling member and the surface of the fuser roller can be held constant. For achieving the aforementioned object, the fixing device of the present invention is characterized in that the end portion of the peeling member is formed such that the gap between the end of the peeling member and the surface of the fuser roller is held constant or alternatively that the end portion of the peeling member is formed such that the gap between the end of the peeling member and the surface of the fuser roller at the both side portions thereof is greater than the gap between the end of the peeling member and the surface of the fuser roller at the middle portion thereof.

BRIEF DESCRIPTION OF THE DRAWINGS

FIG. 8 is a diagram (table) showing the results of experiments according to the present invention;

DESCRIPTION OF THE PREFERRED EMBODIMENTS

Figure 1:
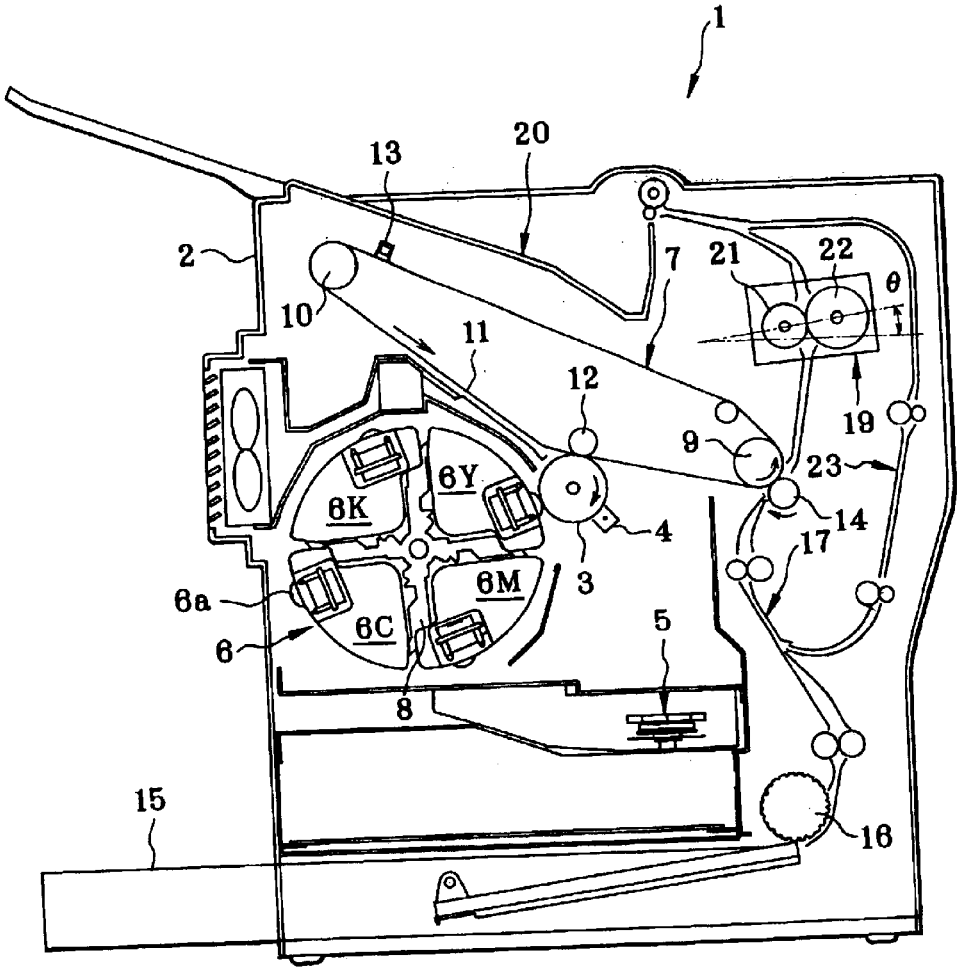
FIG. 1 is an illustration of the entire structure of an image forming apparatus, showing an embodiment of a fixing device according to the present invention.

Hereinafter, embodiments of the present invention will be described with reference to the attached drawings. FIG. 1 is an illustration of the entire structure of an image forming apparatus, showing an embodiment of a fixing device according to the present invention.

In an apparatus body 2 of an image forming apparatus 1, an image carrier 3 consisting of a photosensitive drum is arranged and is driven to rotate in a direction of an arrow, shown in FIG. 1, by a driving means (not shown). Arranged around the image carrier 3, along the rotational direction thereof, are a charging device 4 for uniformly charging the image carrier 3, an exposure device 5 for forming a electrostatic latent image on the image carrier 3, a rotary developing device 6 for developing the electrostatic latent image, and an intermediate transfer device 7 for primary transfer of a unicolor toner image formed on the image carrier 3.

The rotary developing device 6 comprises a yellow developing unit 6Y, a magenta developing unit 6M, a cyan developing unit 6C, and a black developing unit 6B which are attached to a support frame 8. The support frame 8 is driven to rotate by a driving motor (not shown). The rotary developing device 6 is rotated and moved such that one of these developing units 6Y, 6C, 6M, 6K is selectively disposed to face the image carrier 3 for every rotation of the image carrier 3. Each of the developing units 6Y, 6C, 6M, 6K has a toner storage portion for storing toner of the corresponding color.

The intermediate transfer device 7 comprises a driving roller 9 and a driven roller 10, an intermediate transfer belt 11 to be driven by the two rollers in a direction of an arrow, shown in FIG. 1, a primary transfer roller 12 which is disposed on the back of the belt 11 at a position corresponding to the image carrier 3, a transfer belt cleaner 13 for removing residual toner on the belt 11, and a secondary transfer roller 14 which is disposed opposite to the driving roller 9 to transfer a full color image of four colors formed on the intermediate transfer belt 11 onto a recording medium (such as a paper sheet).

A sheet cassette 15 is arranged at a bottom portion of the apparatus body 2. Recording media in the sheet cassette 15 are fed one by one to an outfeed tray 20 through a pickup roller 16, a recording media feeding path 17, a secondary transfer roller 14, and a fixing device 19. Numeral 23 designates a dual-side printing passage.

The actions of the image forming apparatus having the aforementioned structure will be explained below. As an image forming signal is inputted into a control unit from a computer (not shown), the image carrier 3, the respective development rollers 6*a* of the developing device 6, and the intermediate transfer belt 11 are driven to rotate. The outer surface of the image carrier 3 is uniformly charged by the charging device 4. The outer surface of the image carrier 3 is exposed to selective light corresponding to image information for the first color (e.g. yellow) by the exposure device 5, thereby forming an electrostatic latent image for yellow.

The yellow developing unit 6Y is moved so that its developing roller 6*a* is brought in contact with a portion of the image carrier 3 where the electrostatic latent image has been formed, thereby forming an yellow toner image on the image carrier 3. The toner image thus formed on the image carrier 3 is transferred to the intermediate transfer belt 11 by the primary transfer roller 12. During this, the secondary transfer roller 14 is spaced apart from the intermediate transfer belt 11.

In response to image forming signals for the second color, the third color, and the fourth color, the processes of the latent image formation, the development, the transfer according to the rotation of the image carrier 3 and the intermediate transfer belt 11 are repeated, whereby toner images of four colors corresponding to the image forming signals are transferred to and superposed on the intermediate transfer belt 11. In synchronization with the movement of the full-color image reaching the secondary transfer roller 14, a receiving medium is fed to the secondary transfer roller 14 through the feeding passage 17. At this point, the secondary transfer roller 14 is pressed against the intermediate transfer belt 11 and a secondary transfer voltage is applied, whereby the full-color toner image on the intermediate transfer belt 11 is transferred to the recording medium. The toner image transferred to the recording medium is heated and pressed by the fixing device 19 so that the toner image is fixed. Residual toner on the intermediate transfer belt 11 is removed by the transfer belt cleaner 13.

In case of dual-side printing, the recording medium after the fixing device 19 is switched back and supplied to the secondary transfer roller 14 through the dual-side printing passage 23. At the secondary transfer roller 14, a full-color toner image on the intermediate transfer belt 11 is transferred to the recording medium and is again heated and pressed to be fixed at the fixing device 19.

In FIG. 1, the fixing device 19 according to the present invention comprises a heating fixing member 21 composed of a fuser roller having a heat source and a pressure member 22 composed of a pressure roller to be pressed against the fuser roller. The fuser roller 21 and the pressure roller 22 are arranged such that the angle formed between a line connecting the axis of the fuser roller 21 and the axis of the pressure roller 22 and a horizontal line becomes θ. The angle θ is defined as $0° \leqq \theta \leqq 30°$.

Figure 2:
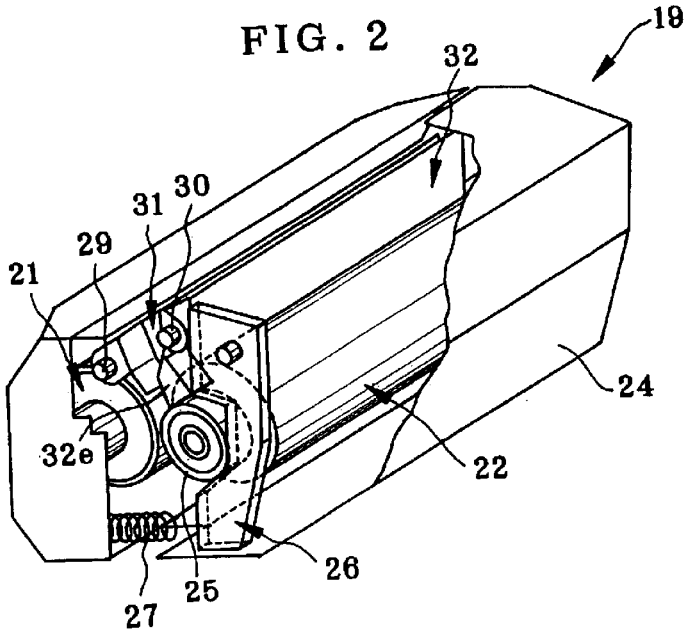
FIG. 2 is a perspective view showing the detail structure of the fixing device shown in FIG. 1 with being partially broken away.
Figure 3:
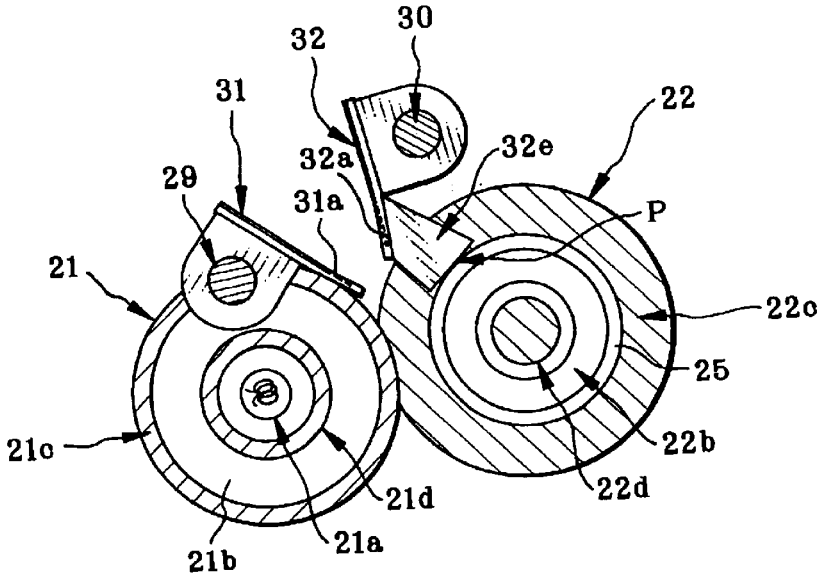
FIG. 3 is a sectional view of main parts of the device shown in FIG. 2.
Figure 4:
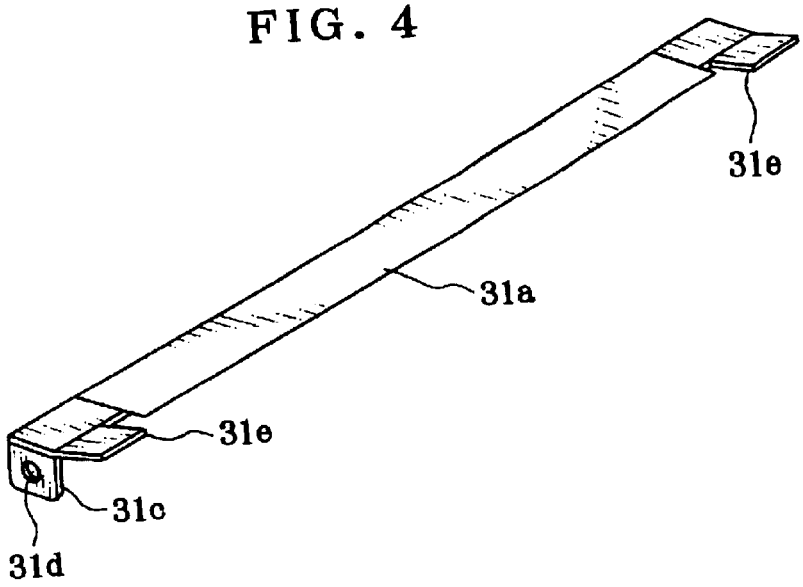
FIG. 4 is a perspective view of a peeling member shown in FIG. 2.
Figure 5:
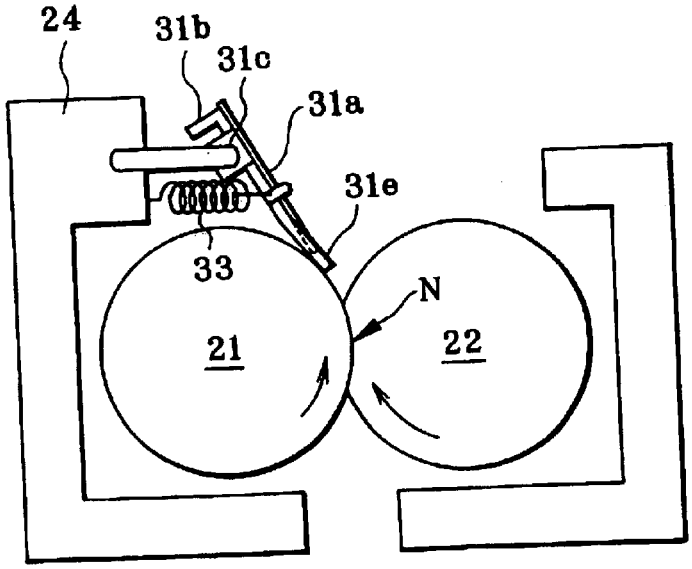
FIG. 5 is a side view showing an installation state of the peeling member shown in FIG. 2.
Figure 6:
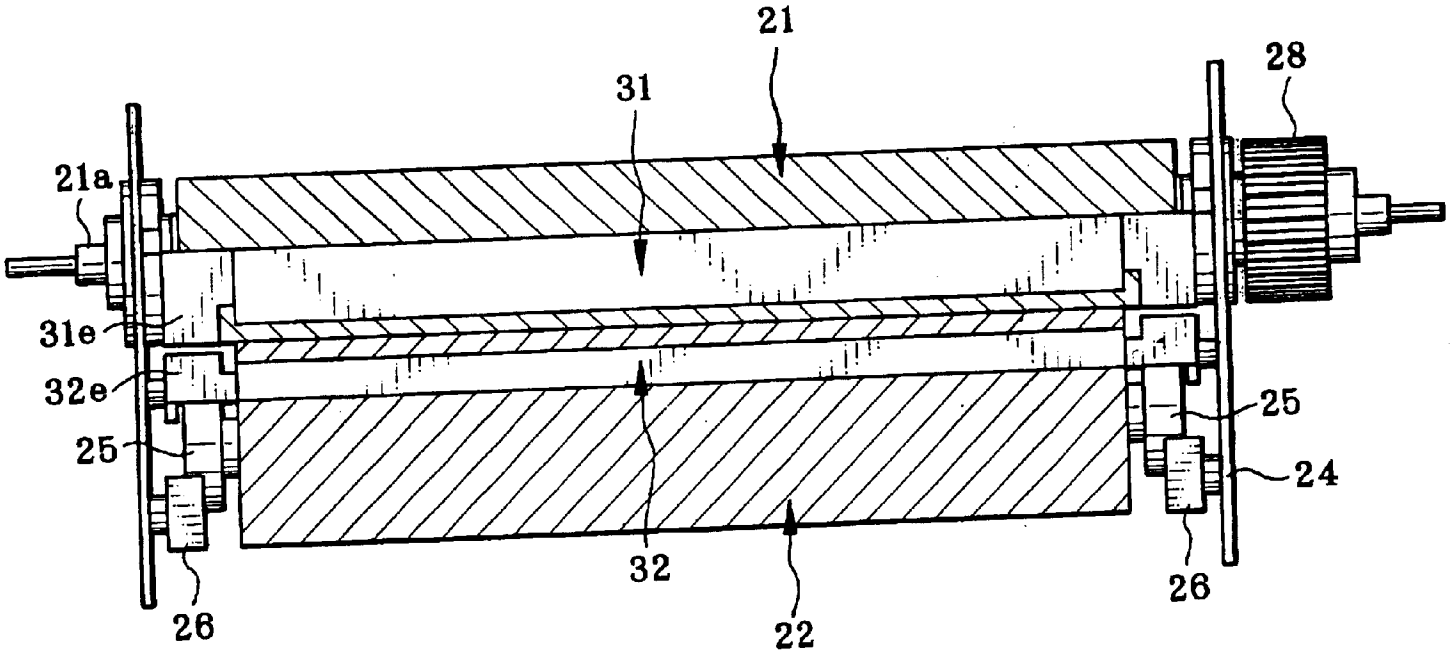
FIG. 6 is a plan view of the fixing device shown in FIG. 2 taken from the top.

FIG. 2 through FIG. 6 show the detail of the fixing device 19 shown in FIG. 1. FIG. 2 is a perspective view showing the fixing device with being partially broken away, FIG. 3 is a sectional view of main parts of the device, FIG. 4 is a perspective view of a peeling member shown in FIG. 2, FIG. 5 is a side view showing an installation state of the peeling member, and FIG. 6 is a plan view of the fixing device shown in FIG. 2 taken from the top. In these drawings, the same parts are designated with the same numerals and the description about such parts will be omitted.

In FIG. 2 and FIG. 6, the fuser roller 21 is rotatably disposed in a housing 24. Connected to one side of the fuser roller 21 is a driving gear 28. The pressure roller 22 is rotatably disposed to face the fuser roller 21. The length of the pressure roller 22 in the axial direction is shorter than that of the fuser roller 21. Bearings 25 are arranged in spaces formed because of difference in length so that the pressure roller 22 is supported by the bearings 25 at both ends of the pressure roller 22. A pressure lever 26 is rotatably disposed on each bearing 25 and a pressure spring 27 is disposed between one end of the pressure lever 26 and the housing 24, whereby the pressure roller 22 and the fuser roller 21 are pressed against each other.

In FIG. 3, the fuser roller 21 comprises a cylindrical body 21*b* made of a metal having a heat source 21*a* such as a halogen lamp therein, an elastic layer 21*c* made of silicone rubber or the like provided on the outer periphery of the cylindrical body 21*b*, an outer layer (not shown) made of fluoro rubber, fluoro resin (e.g. Polytetra Fluoroethylene (PTFE)) coating on the surface of the elastic layer 21*c*, and a rotary shaft 21*d* fixed to the cylindrical body 21*b*.

The pressure roller 22 comprises a cylindrical body 22*b* made of a metal, a rotary shaft 22*d* fixed to the cylindrical body 22*b*, the bearings 25 supporting the rotary shaft 22*d*, an elastic layer 22*c* provided on the outer periphery of the cylindrical body 22*b*, and an outer layer (not shown) made of fluoro rubber, fluoro resin coating on the surface of the elastic layer 22*c*, similarly to the fuser roller 21. The thickness of the elastic layer 21*c* of the fuser roller 21 is extremely smaller than the thickness of the elastic layer 22*c* of the pressure roller 22, thereby forming a fixing nip portion N where the pressure roller 22 is concaved.

As shown in FIG. 2 and FIG. 3, supporting shafts 29, 30 are disposed on both sides of the housing 24. A peeling member 31 for the fuser roller 21 and a peeling member 32 for the pressure roller 22 are attached to the supporting shafts 29, 30, respectively such that the peeling members 31, 32 are pivotable. That is, the peeling members 31, 32 are arranged on downstream side in the recording medium feeding direction of the nip portion to extend in the axial direction of the fuser roller 21 and the pressure roller 22.

The peeling member 31 for the fuser roller 21 has a resin sheet or a metal sheet as a substrate and a fluoro resin layer formed on the surface of the substrate, as shown in FIG. 4 and FIG. 5. The peeling member 31 comprises a plate-like peeling portion (substrate) 31*a*, a bent portion 31*b* which is positioned behind the peeling portion 31*a* and is bent into L-like shape toward the fuser roller 21, supporting pieces 31*c* which are positioned on both sides of the peeling portion 31*a* and are bent downward, fitting holes 31*d* formed in the supporting pieces 31*c*, and guide portions 31*e* which are positioned on both sides of the peeling portion 31*a* to extend forward.

The peeling portion 31*a* is arranged to be inclined toward the outlet of the nip portion N such that the end of the peeling portion 31*a* is in non-contact with and in proximity to the fuser roller 21. The supporting shafts 29 described above with regard to FIG. 3 are fitted into the fitting holes 31*d*. The guide portions 31*e* are biased toward the housing 24 by springs 33, whereby the ends of the guide portions 31*e* are in contact with the fuser roller 21. As a result, the gap between the end of the peeling portion 31*a* and the surface of the fuser roller 21 is always held constant.

The peeling member 32 for the pressure roller 22 has a similar configuration as the peeling member for the fuser roller 21. As shown in FIG. 2 and FIG. 3, the end of a peeling portion 32*a* is positioned on the further downstream side in the recording medium feeding direction relative to the end of the peeling portion 31*a*. The ends of guide portions 32*e* are in contact with the outer peripheries of the bearings 25 of the pressure roller 22 at points P, whereby the gap between the end of the peeling portion 32*a* and the surface of the pressure roller 22 is always held constant.

Now, characteristics of the present invention will be described. Conventionally, since the fuser roller 21 and the pressure roller 22 are generally arranged one above the other to be aligned in the vertical direction, a force acts on the recording medium, going out of the nip portion, in a direction moving apart from the fuser roller 21 because of gravitation so that the prospect of peeling the recording medium by the peeling member is low. However, when the fuser roller 21 and the pressure roller 22 are aligned in substantially the horizontal direction so that the recording medium feeding direction is substantially the vertical direction as shown in FIG. 1, the recording medium easily winds around the fuser roller 21. Further, in case of dual-side printing, there is also a problem that toner on the pressure roller 22 side corresponding to locations where no toner is transferred on the fuser roller 21 is fused so that the recording medium easily winds around the pressure roller 22. It may be conceived that another peeling member 32 is provided on the pressure roller 22 side. However, similarly to the peeling member on the fuser roller 21 side, there is a problem that a gap between the end of the peeling member and the pressure roller must be held always constant.

Therefore, according to the present invention, the peeling members 31, 32 are arranged on the downstream side in the recording medium feeding direction relative to the nip portion N to extend in the axial direction of the fuser roller 21 and the pressure roller 22. The end portion of the peeling member 31 for the fuser roller 21 is arranged to be inclined toward the outlet of the nip portion N such that the end of the peeling portion 31*a* is in non-contact with and in proximity to the fuser roller 21. The end of the peeling member 32 for the pressure roller 22 is positioned on the further downstream side in the recording medium feeding direction relative to the end of the peeling member 31.

As shown in FIG. 5, the peeling member 31 for the fuser roller 21 is biased toward the housing 24 by the springs 33, whereby the ends of the guide portions 31*e* are in contact with the fuser roller 21. As a result, the gap between the end of the peeling portion 31*a* and the surface of the fuser roller 21 is positioned to be always held constant.

The peeling member 32 for the pressure roller 22 has a similar configuration as the peeling member for the fuser roller 21. As shown in FIG. 2 and FIG. 3, the end of the peeling portion 32*a* is positioned on the further downstream side in the recording medium feeding direction relative to the end of the peeling portion 31*a*. The ends of the guide portions 32*e* are in contact with the outer peripheries of the bearings 25 of the pressure roller 22 at the points P, whereby the gap between the end of the peeling portion 32*a* and the surface of the pressure roller 22 is positioned to be always held constant. Therefore, as shown in FIG. 6, the length of the pressure roller 22 in the axial direction is shorter than that of the fuser roller 21. The bearings 25 are arranged in spaces formed because of difference in length so that the pressure roller 22 is supported by the bearings 25 at both sides of the pressure roller 22.

In case of dual-side printing, a recording medium of which one side is printed is peeled off by the peeling member 31 for the fuser roller 21. After that, the recording medium is switched back such that the forward end of the recording medium becomes the rear end and is supplied to the secondary transfer roller 14 through the dual-side printing passage 23. At the secondary transfer roller 14, a full-color toner image on the intermediate transfer belt 11 is transferred to the recording medium and is again heated and pressed by the fuser roller 21 so that the image is fixed. The recording medium adhering to and winding around the pressure roller 22 during this fixing process is peeled off by the peeling member 32 for the pressure roller 22.

Figure 7:
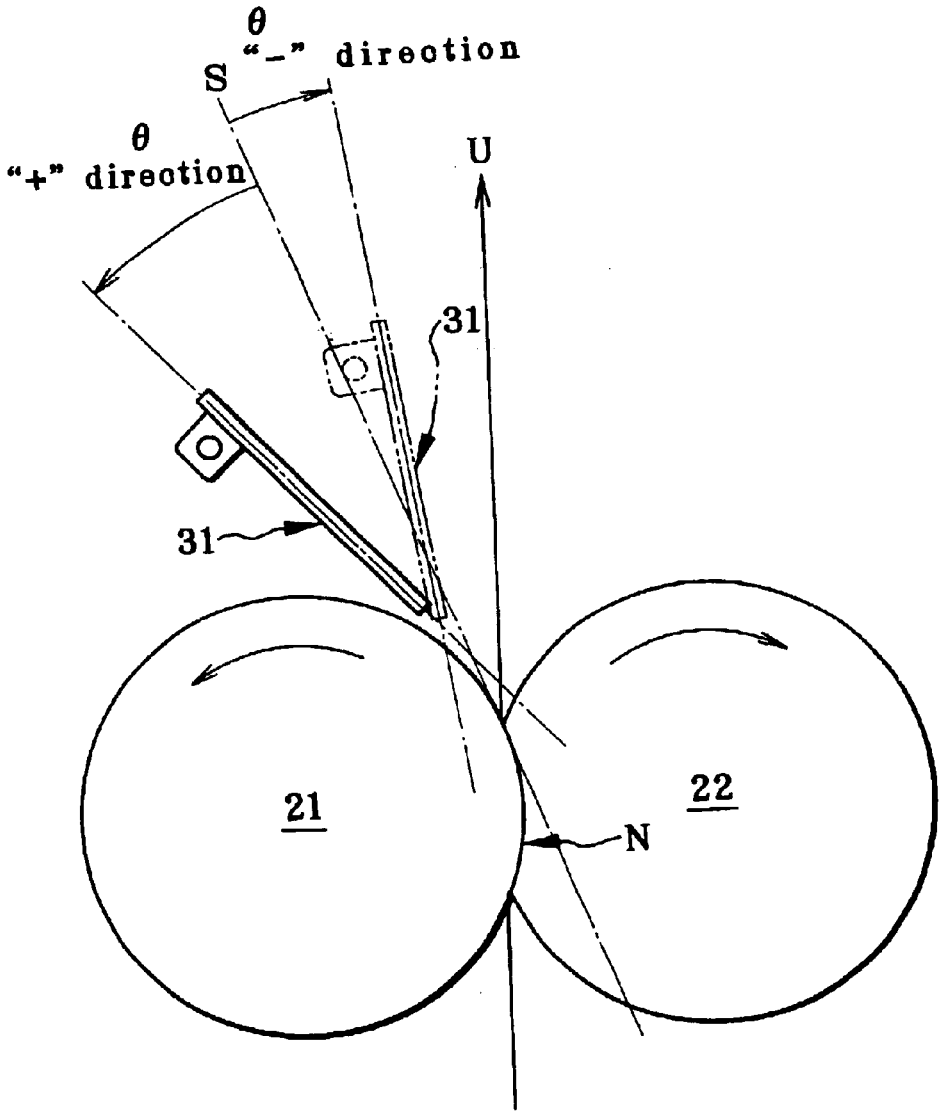
FIG. 7 is a schematic illustration for explaining other features of the present invention.

Now, the other characteristics of the present invention will be described. As shown in FIG. 7, in case that the fuser roller 21 and the pressure roller 22 are aligned in substantially the horizontal direction and a method of feeding a recording medium out of the fixing nip N upwardly is employed, the recording medium easily winds around the fuser roller 21 so that the recording medium always comes in contact with the peeling member 31, that is, the frequency in use of the peeling member is high. In this case, the setting of the alignment angle of the peeling member relative to the recording medium is important. If the alignment angle of the peeling member 31 relative to the recording medium is not good, the peeling performance of recording media should be poor and linear defects may be created on image.

Therefore, in the present invention, evaluation tests for the alignment angle of the peeling member 31 with respect to the recording medium have been conducted with various angles of the peeling member 31 relative to the tangent line S of the outlet of the fixing nip portion N. FIG. 8 shows the results of the evaluation tests. From the results, it is found that good peeling performance without linear defects can be obtained when the alignment angle θ of the peeling member 31 is set in a range $-5° \leqq \theta \leqq 25°$ relative to the tangent line S of the outlet of the fixing nip portion N. It should be noted that the angle is expressed with "+" for the fuser roller 21 side and "−" for the pressure roller 22 side.

EXAMPLE 1

Fuser Roller

Diameter: 30 mm,

Elastic layer: silicone rubber (JIS-A hardness: 5°) with a thickness of 1 mm,

Outer layer: PFA (tetrafluoroethylene/perfluoroalkyl vinyl ether copolymer) with a thickness of 40 μm, with a built-in heater.

Pressure Roller

Diameter: 35 mm,

Elastic layer: silicone rubber (JIS-A hardness: 10°) with a thickness of 6 mm,

Outer layer: PFA with a thickness of 40 μm.

Distance between the outlet of the fixing nip and the end of the peeling portion 31*a*: 6.5 mm, Width of the fixing nip: 8 mm, Fusing Temperature: 185° C., Sheet feeing speed: 215 mm/s, Pressure load on the rollers: 31 kgf.

EXAMPLE 2

Fuser Roller

Diameter: 40 mm,

Elastic layer: silicone rubber (JIS-A hardness: 8°) with a thickness of 1.5 mm,

Outer layer: PFA with a thickness of 40 μm,

Built-in heater.

Pressure Roller

Diameter: 50 mm,

Elastic layer: silicone rubber (JIS-A hardness: 10°) with a thickness of 6 mm,

Outer layer: PFA with a thickness of 40 μm.

Distance between the outlet of the fixing nip and the end of the peeling portion 31*a*: 6.5 mm, Width of the fixing nip: 8 mm, Fusing Temperature: 185° C., Sheet feeing speed: 215 mm/s, Pressure load on the rollers: 26 kgf.

EXAMPLE 3

Fuser Roller

Diameter: 30 mm,

Elastic layer: silicone rubber (JIS-A hardness: 5°) with a thickness of 1 mm,

Outer layer: PFA with a thickness of 40 μm,

Built-in heater.

Pressure Roller

Diameter: 35 mm,

Elastic layer: silicone rubber (JIS-A hardness: 10°) with a thickness of 6 mm,

Outer layer: PFA with a thickness of 40 μm.

Distance between the outlet of the fixing nip and the end of the peeling portion 31*a*: 7.5 mm, Width of the fixing nip: 8 mm, Fusing Temperature: 185° C., Sheet feeing speed: 215 mm/s, Pressure load on the rollers: 31 kgf.

Evaluation items (1) Linear defects on image: a full solid image was printed and "linear defects" as scratch marks by the peeling portion 31*a* were visually observed and evaluated.

○: no linear defects

Δ: minor light linear defects

X: deep and severe linear defects (2) Peeling performance: a full solid image was successively printed on 250 sheets of paper and the number of failures of feeding operation of the fixing device was counted.

◎: no failure

○: one or two sheets having dog ear

Δ: three or four sheets having dog ear

X: five or more sheets having dog ear or paper jam

Figure 9A:
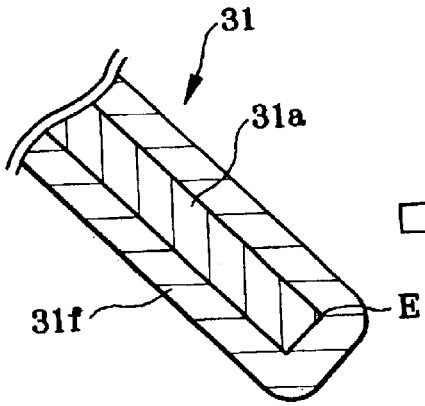
FIGS. 9(A), 9(B) are enlarged sectional views of the peeling member according to the present invention.
Figure 9B:
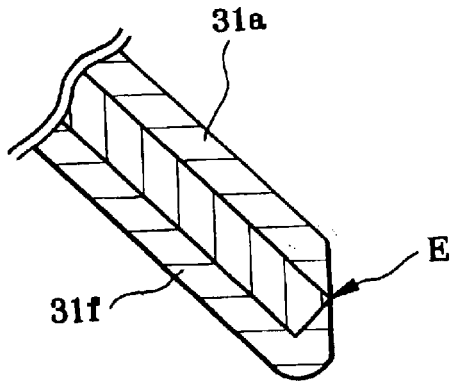
Figure 10A:
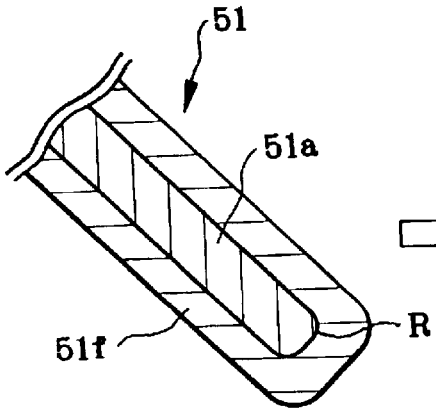
FIGS. 10(A), 10(B) are enlarged sectional views of a conventional peeling member.
Figure 10B:
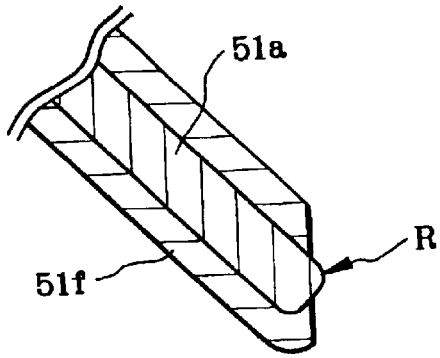

Hereinafter, the peeling member according to the present invention will be explained. As shown in FIG. 9(A), the peeling member 31 according to the present invention comprises a substrate 31*a* having an edge E on the end thereof and a fluoro resin layer 31*f* formed on the surface of the substrate 31*a*. Even if an end portion of the resin layer 31*f* coming in contact with the recording medium is removed due to wear by repeated use over the years as shown in FIG. 9(B), the recording medium comes in linear contact with the peeling member 31 at the edge E so as to prevent toner adhesion and prevent the creation of linear defects, thereby improving the durability of the peeling member 31.

The substrate 31*a* of the peeling member 31 may be made of a metal such as stainless steel, nickel, aluminum, and iron, or a resin such as polyester and polyimide. The Edge E at the end of the substrate 31*a* is processed by a high-precision finishing such as mechanical grinding, electrolytic grinding, and etching.

Examples of the material of the fluoro resin layer 31*f* include thermoplastic fluoro resins such as tetrafluoroethylene/perfluoroalkyl vinyl ether copolymer (PFA), tetrafluoroethylene resin (PTFE), tetrafluoroethylene hexafluoropropylene copolymer (FEP), ehtylene tetrafluoroethylene copolymer (ETFE), ethylene chlorotrifluoroethylene copolymer (ECTFE), Polychlorotrifluoroethylene (PCTFE), polyvinyl fluoride (PVF), tetrafluoroethylene hexafluoropropylene perfluoroalkoxy vinyl ether copolymer (EPE), and polyvinylidenefluoride resin (PVDF), thermoplastic elastomers, other fluoro copolymer resins, and fluorocarbon such as (CF)N and (C2F)F.

Figure 11:
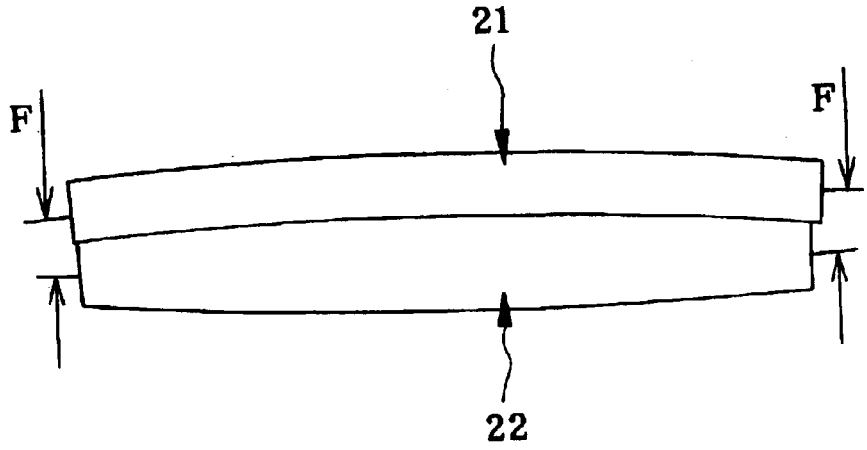
FIG. 11 is a schematic illustration for explaining the problem to be solved by the present invention.

Now, description will be made as regard to the control of the gap between the end of the peeling member and the fuser roller according to the present invention. For peeling off a recording medium from the fuser roller 21 with even force over the entire width of the fuser roller 21, the gap between the end of the peeling member 31 and the fuser roller 21 must be held always constant over the entire length in the axial direction of the fuser roller 21. In addition, as shown in FIG. 11, the fuser roller 21 and the pressure roller 22 are normally biased against each other by force F of the springs 27 (FIG. 2) at the both ends in the axial direction of the rollers so that the middle portion of the pressure roller 22 bulges because the elastic layer of the pressure roller 22 is thick. As a result of this, the surface of the fuser roller 21 is deflected into an arc shape in the axial direction. Therefore, there is a problem that it is very difficult to control the gap between the peeling member 31 and the surface of the fuser roller 21.

Conventionally, since the fuser roller 21 and the pressure roller 22 are generally arranged one above the other to be aligned in the vertical direction, a force acts on the recording medium, going out of the nip portion, in a direction moving apart from the fuser roller because of gravitation so that the prospect of peeling the recording medium by the peeling member is low. However, when the fuser roller 21 and the pressure roller 22 are aligned in substantially the horizontal direction as shown in FIG. 1, the recording medium easily winds around the fuser roller 21 so that the recording medium going out of the nip portion N always comes in contact with the peeling member, that is, the frequency in use of the peeling member is extremely high as compared to the conventional one. Accordingly, the control of the aforementioned gap is a matter of further importance.

Figure 12:
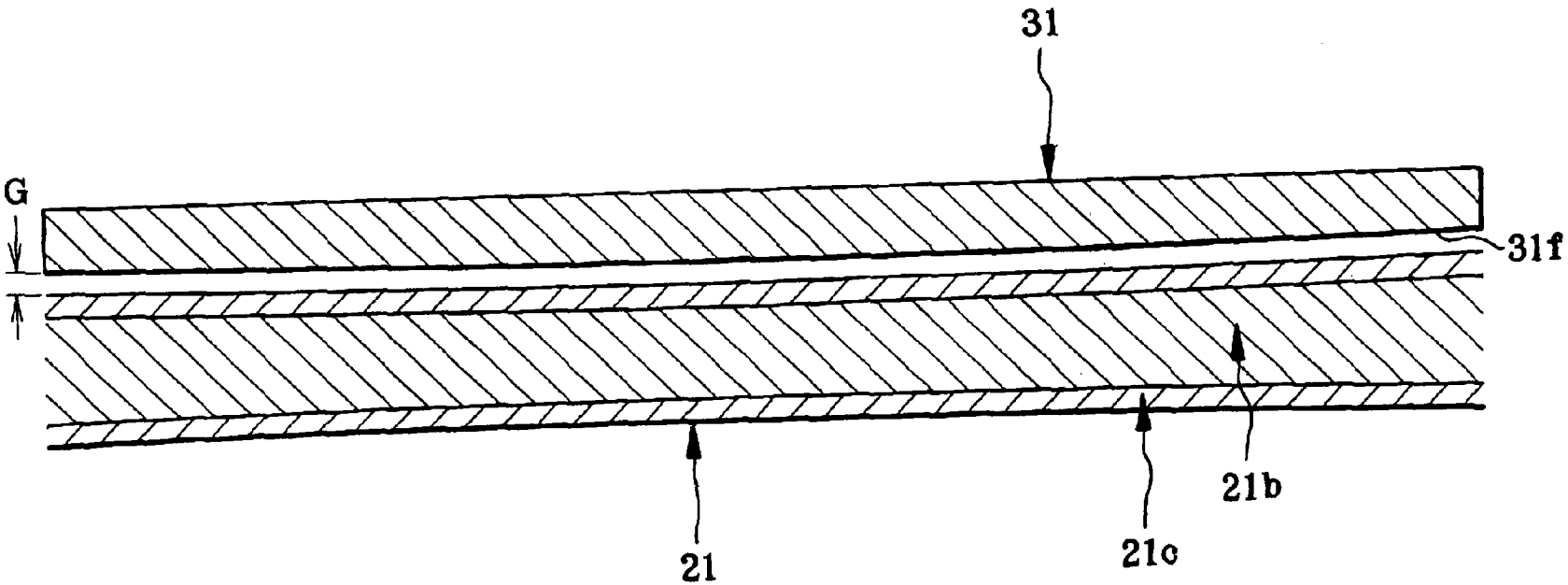
FIG. 12 is a sectional view showing an embodiment of the present invention.

The aforementioned problem is solved by the present invention as the following manner. FIG. 12 is a sectional view showing one embodiment of the present invention. As mentioned above, the fuser roller 21 is biased against the pressure roller 22 by force F of the springs 27 (FIG. 2) at the both ends in the axial direction thereof, the longitudinal section through the axis of the metal cylindrical body 21*b* is formed in a hourglass-like shape and the surface of the elastic layer 22*c* is formed in an arc shape. In addition, the fuser roller 21 is frequently formed in an inversed crown shape (having side portions of which diameter is larger than that of the middle portion thereof) for preventing the creation of creases. This also increases the tendency of arc shape. In this embodiment, the end portion 31*f* of the peeling member 31 is formed in an arc shape in order to make the gap G between the end portion 31*f* of the peeling member 31 and the elastic layer 22*c* constant. The gap G is measured by a micro gauge or a laser displacement gauge.

Figure 13:
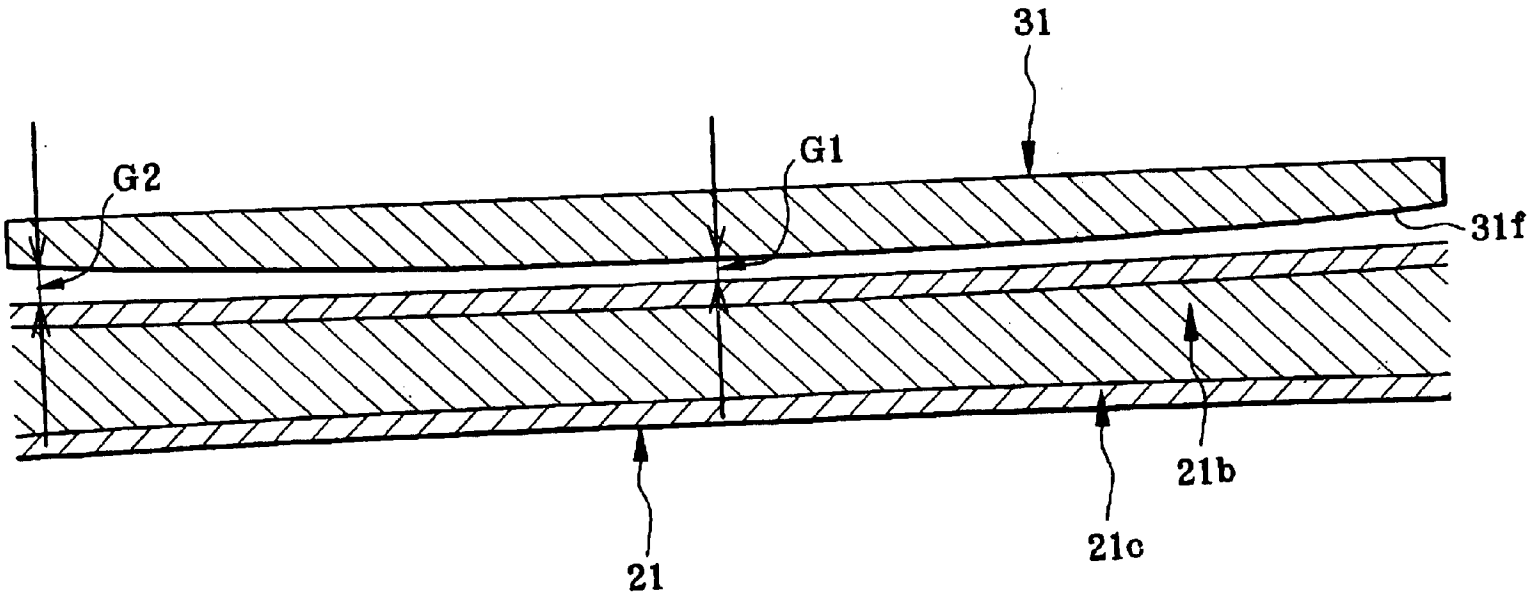
FIG. 13 is a sectional view showing another embodiment of the present invention.

FIG. 13 is a sectional view of another embodiment of the present invention. In this embodiment, the end portion 31*f* of the peeling member 31 is formed such that gap G2 between the end of the peeling member 31 and the surface of the fuser roller 21 at the both side portions thereof is greater than the gap G1 between the end of the peeling member 31 and the surface the fuser roller 21 at the middle portion thereof. In this embodiment, the middle portion of the peeling member 31 (the portion first comes in contact with the recording medium) is proximal to the fuser roller 21. In this structure, the control of the gap is facilitated so that the peeling member 31 can be easily manufactured without losing substantial peeling performance. Since the portion in proximity to the fuser roller 21 is reduced, the damage of the peeling member 31 and the fuser roller 21 due to object matters or paper jam is reduced, thereby improving the durability and the reliability of the peeling member 31 and the fuser roller 21.

Though the present invention has been described with reference to the embodiments disclosed herein, the present invention is not limited thereto and various changes may be made therein. The present invention may be adopted to conventionally known techniques and these techniques may be combined. For example, though the peeling member 31 for the fuser roller 21 has bee explained in the aforementioned embodiments, the present invention may be adopted to the peeling member 32 for the pressure roller 22.

What is claimed is:

1. A fixing device comprising: a fuser roller having a heat source, a pressure roller to be pressed against the fuser roller, and peeling members which are arranged on the downstream side in a recording medium feeding direction relative to a fixing nip portion to extend in the axial direction of the fuser roller and the pressure roller and are disposed in proximity to the fuser roller and the pressure roller, respectively, wherein the positioning of the peeling member for said fuser roller is conducted on the surface of the fuser roller, positioning of the peeling member for said pressure roller is conducted on surfaces of bearings for the pressure roller.

2. A fixing device as claimed in claim 1, wherein the length in the axial direction of said pressure roller is shorter than that of said fuser roller and said bearings are arranged in spaces formed because of the difference in length.

3. A fixing device as claimed in claim 1, wherein said fuser roller and said pressure roller are aligned in substantially the horizontal direction so that the recording medium feeding direction is the vertical direction.

4. A fixing device as claimed in claim 3, wherein the end of the peeling member for said pressure roller is positioned on the downstream side in the recording medium feeding direction relative to the end of the peeling member for the fuser roller.

5. A fixing device as claimed in claim 3, wherein an alignment angle $\theta$ of the peeling member for said fuser roller is set in a range $-5 \leqq \theta \leqq 25°$ relative to a tangent line of the outlet of the fixing nip portion.

6. A fixing devise as claimed in claim 3, wherein said peeling member comprises a substrate having an edge at the end thereof and a fluoro resin layer formed on the surface of said substrate.

7. A fixing device as claimed in claim 3, wherein the end portion of said peeling member is formed such that the gap between the end of the peeling member and the surface of the fuser roller is held constant.

8. A fixing device as claimed in claim 3, wherein the end portion of said peeling member is formed such that the gap between the end of the peeling member and the surface of the fuser roller at the both side portions thereof is greater than the gap between the end of the peeling member and the surface of the fuser roller at the middle portion thereof.

* * * * *

UNITED STATES PATENT AND TRADEMARK OFFICE

CERTIFICATE OF CORRECTION

PATENT NO. : 6,839,537 B2
DATED : January 4, 2005
INVENTOR(S) : Syuhei Mouri et al.

It is certified that error appears in the above-identified patent and that said Letters Patent is hereby corrected as shown below:

Title page,
Item [75], should read:
-- [75] Inventors: Suyhei Mouri, Nagano-ken (JP)
Kazutoshi Fujisawa, Nagano-ken (JP)
Takeshi Tajima, Nagano-ken (JP)
Hiroshi Takehana, Nagano-ken (JP) --.

Signed and Sealed this

Eleventh Day of April, 2006

JON W. DUDAS
*Director of the United States Patent and Trademark Office*